US006269805B1

(12) United States Patent
Wilson

(10) Patent No.: US 6,269,805 B1
(45) Date of Patent: Aug. 7, 2001

(54) MANIFOLD SPACER

(76) Inventor: Keith Wilson, 4700 NE. 11th Ave., Fort Lauderdale, FL (US) 33334

( * ) Notice: Subject to any disclaimer, the term of this patent is extended or adjusted under 35 U.S.C. 154(b) by 0 days.

(21) Appl. No.: 09/504,423

(22) Filed: Feb. 15, 2000

(51) Int. Cl.[7] ..... F02M 25/10
(52) U.S. Cl. ..... 123/585; 123/1 A; 123/184.53
(58) Field of Search ..... 123/1 A, 184.53, 123/564, 585, 590; 60/600, 611; 137/68.19, 68.21

(56) References Cited

U.S. PATENT DOCUMENTS

| | | | | |
|---|---|---|---|---|
| 4,494,488 | * | 1/1985 | Wheatley | 123/1 A |
| 4,598,549 | | 7/1986 | Kanawyer | 60/611 |
| 4,688,384 | | 8/1987 | Pearman et al. | 60/600 |
| 4,791,906 | | 12/1988 | Ecomard | 123/564 |
| 5,090,392 | | 2/1992 | Nakano et al. | 123/564 |
| 5,137,003 | | 8/1992 | Kyoya et al. | 123/564 |
| 5,150,669 | | 9/1992 | Rush, II et al. | 123/184.42 |
| 5,269,275 | * | 12/1993 | Dahlgren | 123/1 A X |
| 5,482,079 | | 1/1996 | Bozzelli | 137/561 A |
| 5,507,256 | * | 4/1996 | Czadzeck | 123/184.53 |
| 5,743,241 | | 4/1998 | Wood et al. | 123/531 |

* cited by examiner

*Primary Examiner*—Tony M. Argenbright
(74) *Attorney, Agent, or Firm*—Richard M. Saccocio PA

(57) ABSTRACT

An insert adapted to be placed between a carburetor or a throttle body and an intake manifold of an internal combustion engine is provided with a fuel manifold, a nitrous oxide manifold, and one or more burst diaphragms in a wall of said insert. Said manifolds are arranged one over the other and across an opening in said insert. A plurality of orifices extend along the length of each manifold, and are arranged to direct flow outward, downward, and radially relative to the axial flow of the fuel-oxidizer mixture through the insert.

16 Claims, 4 Drawing Sheets

MANIFOLD SPACER

BACKGROUND OF THE INVENTION a) Field of the Invention

This invention relates in general to the field of automobile intake manifolds and in particular to apparatus positioned between a carburetor or a throttle body and an intake manifold which is particularly adaptable to an automobile engine utilizing nitrous oxide and additional fuel as a means to increase power.

b) Description of the Prior Art

The principle of operation of an internal combustion engine is well known. A mixture of an oxidizer (usually air) and fuel is directed to a cylinder and an associated piston. The piston compresses the mixture, which is then caused to ignite by the action of a spark. The burning mixture pushes the piston back down causing rotation of a crankshaft. The burned mixture is expelled from the cylinder, which is followed by a fresh charge of fuel and oxidizer into the cylinder and the process repeats itself.

The power output from an internal combustion engine is directly related to the amount of fuel capable of being burned during each power stroke of the piston. However, in order for the fuel to burn, an oxidizer must be present to support the combustion. Ideally, the ratio of fuel to oxidizer is such that all of the fuel is completely burned prior to being expelled from the engine. In addition to obtaining an ideal fuel-oxidizer ratio, it is most important that there is complete mixing of the fuel and oxidizer. In reality the ability to attain the ideal fuel-oxidizer ratio and to completely burn all of the fuel introduced into the cylinders of an internal combustion engine are never realized. This is especially true in high power output engines where as much fuel as possible is packed into each cylinder. The more fuel that is introduced, the greater the inability to completely mix the fuel and oxidizer and burn all of the fuel.

Burning as much of the fuel introduced into each cylinder during the power stroke of engines used for transportation or racing purposes is almost as important as achieving large amounts of power from the engine. Inefficient burning of the fuel results in poor fuel economy, which is generally unacceptable.

Poor fuel economy is a factor to be considered in endurance racing. Other things being equal, a racecar suffering from poor fuel economy will be required to make more pit stops to take on fresh fuel. The extra time occasioned by the increased number of stops could be the difference between winning and losing the race. Accordingly, high-power output coupled with good fuel economy in endurance racing is an important consideration.

One means used by race and streetcars to achieve high-power and acceptable fuel economy is by the injection of nitrous oxide and extra fuel into the fuel-air mixture. The nitrous oxide being an excellent oxidizer serves to burn the extra fuel being added to the original air-fuel mixture. In the prior art, the introduction of the nitrous oxide is at a location between the carburetor or the throttle body and the intake manifold of an engine. Usually, a spacer is provided at this location and the nitrous oxide and fuel injection orifices are contained within the spacer. Even with the use of nitrous oxide and the added fuel, it is most important that proper mixing of the nitrous oxide with the added fuel be accomplished. In the prior art, the nitrous oxide and the added fuel are simply sprayed through a plurality of holes in a tube or tubes arranged across the opening of the spacer without any regard to any particular spray pattern to insure proper mixing.

Another problem existing in the prior art is that intake manifold damage is caused by a backfire. A backfire occurs when the fuel-oxidizer mixture ignites within the intake manifold causing a flame to shoot back through the carburetor or throttle body. The pressure built up by the advancing flame is exceedingly high and often results in damaging the carburetor or the throttle body and or damaging the intake manifold. Burst diaphragms strategically located on the intake manifold have to some extent minimized some but not all of the damage which can result. In a racecar, damage to the carburetor or the throttle body and or the intake manifold is totally unacceptable.

Accordingly, a primary object of the present invention is to provide apparatus which can be positioned between the intake manifold and the carburetor or the throttle body of an internal combustion engine which provides efficient or improved mixing of the nitrous oxide and the fuel being added to the engine, to improve the distribution of the fuel and oxidizer into the cylinders of the engine, and to protect against damage caused by a backfire.

SUMMARY OF THE INVENTION

The present invention comprises apparatus adapted to be inserted between the outlet of a carburetor or a throttle body and the inlet of an intake manifold. Pressure relief apparatus is provided in one or more walls of the inserted apparatus. A fuel manifold is provided across opposite walls of the inserted apparatus. A nitrous oxide manifold is also provided across opposite walls of the inserted apparatus. Outlet holes in both the fuel and nitrous oxide manifolds are uniquely arranged to optimize the atomization or mixing the added fuel and the nitrous oxide, to uniquely distribute the atomized mixture across the opening of the intake manifold, and to evenly distribute the atomized fuel-oxidizer mixture to each cylinder of the engine.

DESCRIPTION OF THE PREFERRED EMBODIMENTS

Figure 1:
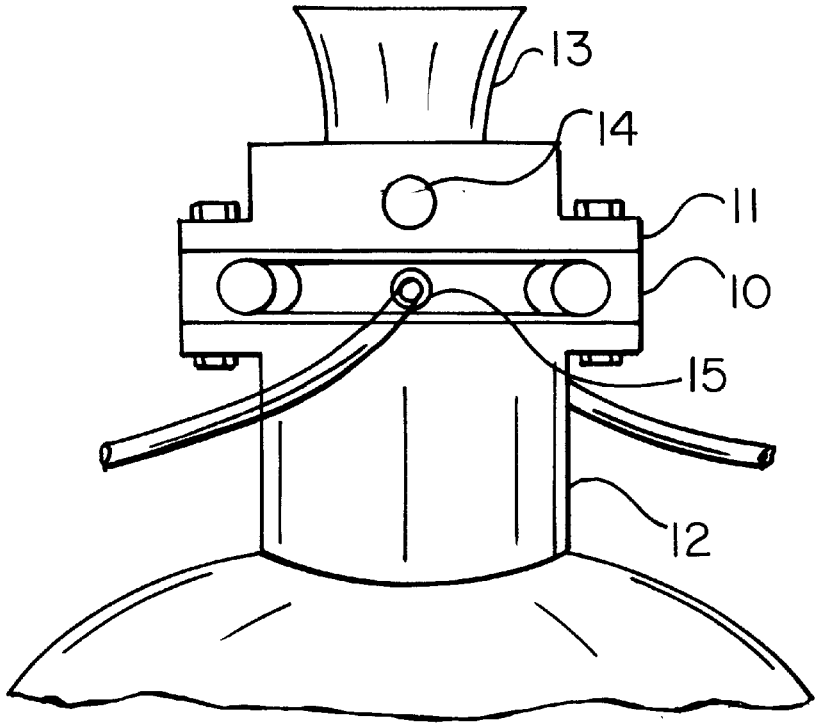
FIG. 1 schematically illustrates the fuel-oxidizer intake portion of an internal combustion engine illustrating the position of the inventive insert apparatus.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Also, the terminology used herein is for the purpose of description and not of limitation.

Reference is now made to the drawings, wherein like characteristics and features of the present invention shown in the various figures are designated by the same reference numerals.

FIG. 1 schematically illustrates a portion of the intake system of an internal combustion engine in which the inventive insert apparatus 10 is positioned between a carburetor or a throttle body 11 and the entrance to the intake manifold 12. If the engine is equipped with a carburetor 11, air and fuel are introduced and mixed within the carburetor11. If the engine is equipped with port fuel injection, air is introduced through the throttle body 11 while the fuel is introduced and mixed downstream of the insert 10. If the engine is equipped with throttle body fuel injection, both the fuel and the air are introduced and mixed within the throttle body 11. The inventive insert 10 is applicable to all such engines. In the schematic, air enters the carburetor or throttle body 11 while the fuel enters either the throttle body, the carburetor, or the intake manifold downstream of the insert 10, depending on the engine fuel arrangement. Nitrous oxide, which is an oxidizer, is introduced to the engine through an oxidizer manifold 15 positioned across and within the insert 10. Additional fuel is also introduced to the engine through a fuel manifold 16 also positioned across and within the insert 10. The fuel and oxidizer added through the insert 10 are mixed within the insert 10 and then channeled to the cylinders of the engine through the intake manifold 12. Because of the improved mixing of the added fuel and the nitrous oxide accomplished by the inventive insert 10, the distribution of the overall fuel-oxidizer mixture from the intake manifold 12 between each of the cylinders of the engine is also improved.

Figure 2:
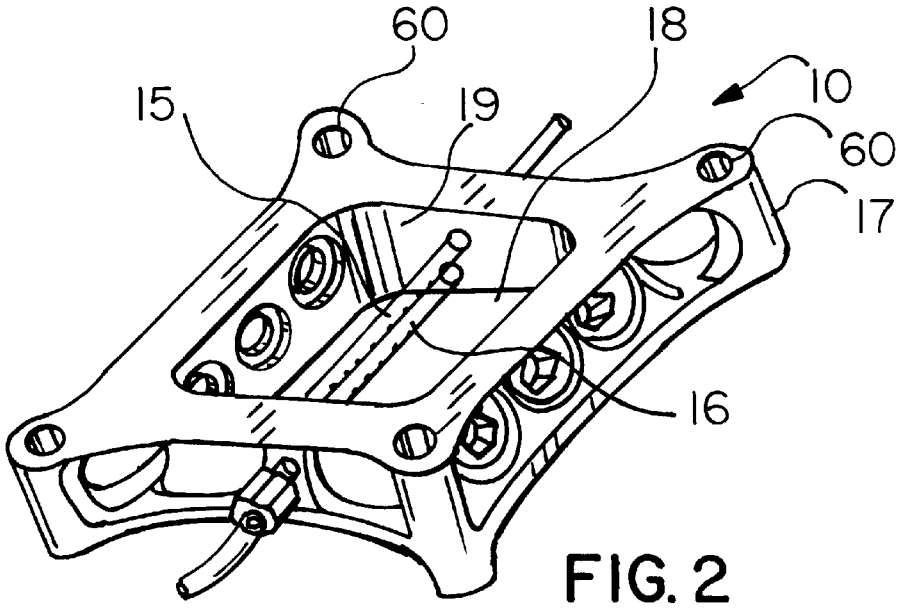
FIG. 2 is an isometric view of the inventive insert apparatus.
Figure 3:
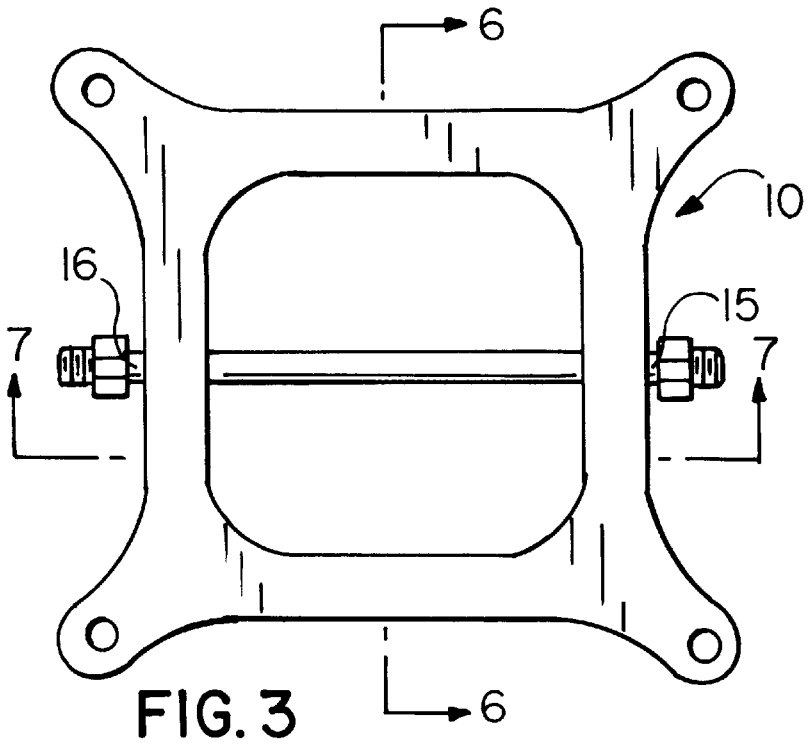
FIG. 3 is a top plan view of one embodiment of the inventive insert apparatus.
Figure 4:
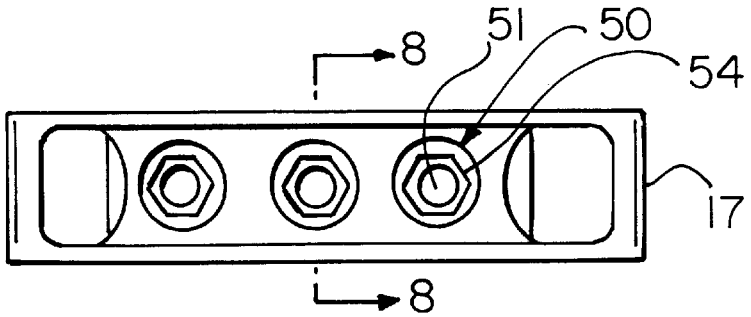
FIG. 4 is a frontal view of the insert apparatus of FIG. 3.
Figure 5:
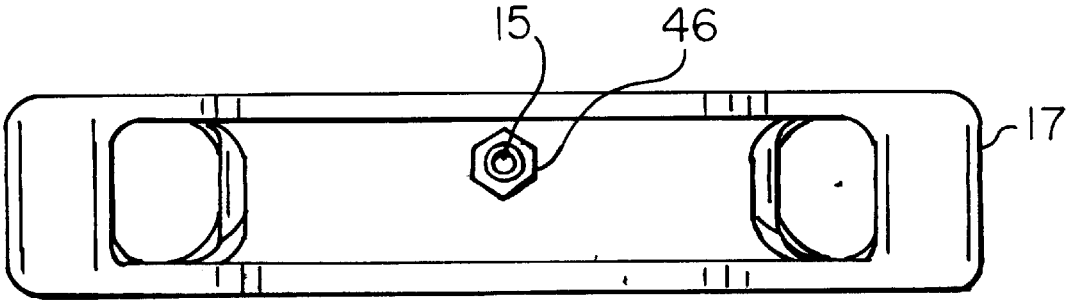
FIG. 5 is a side view of the insert apparatus of FIG. 3.
Figure 6:
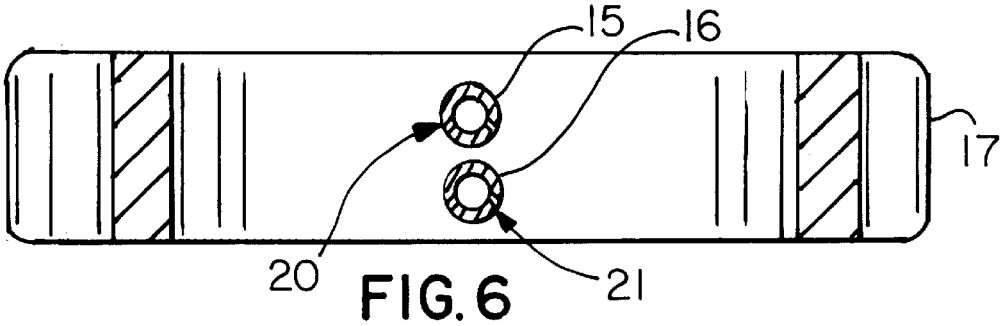
FIG. 6 is a cross-sectional view of the insert apparatus of FIG. 3 taken along the line 6—6 thereof.
Figure 7:
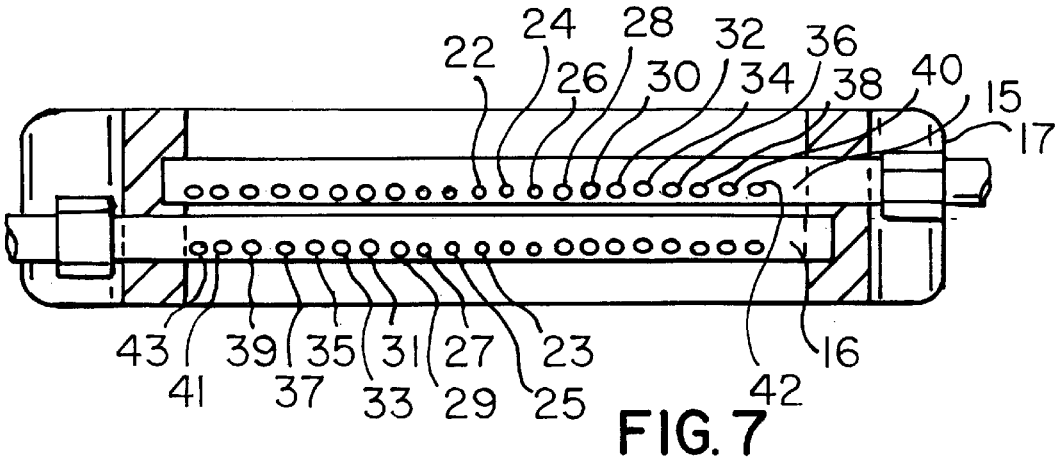
FIG. 7 is a cross sectional view of the insert apparatus of FIG. 3 taken along the line 7—7 thereof.
Figure 8:
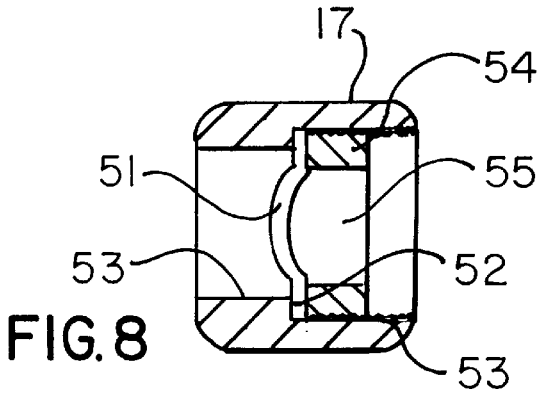
FIG. 8 is an enlarged cross-sectional view taken along the line 8—8 of FIG. 4.
Figure 9:
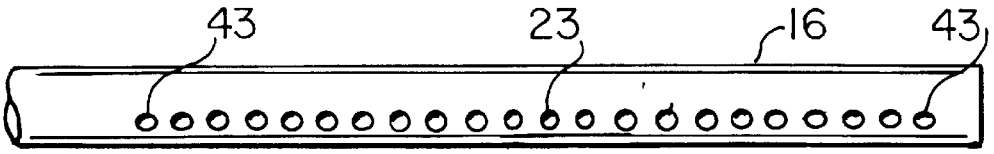
FIG. 9 is an enlarged side view of the fuel manifold.
Figure 10:
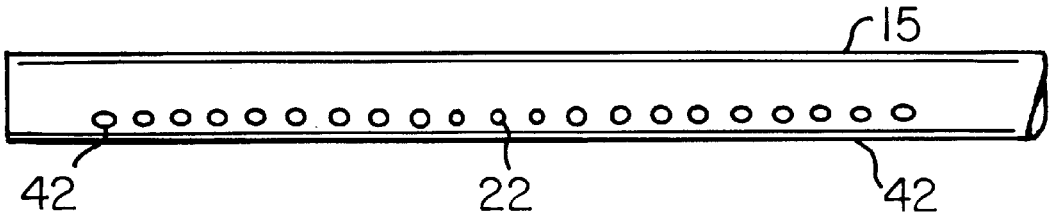
FIG. 10 is an enlarged side view of the nitrous oxide manifold.

An isometric view of the inventive insert apparatus 10 is shown in FIG. 2. A top plan view of the insert apparatus 10 is shown in FIG. 3. Referring also to FIGS. 6 and 7, it is seen that the insert 10 comprises a body member 17 having an opening 18 therethrough. The size of opening 18 is consistent with the outlet opening of the carburetor or throttle body 11 and the inlet opening to the intake manifold 12. The interior surface 19 of insert 10 is smooth so as to eliminate any flow restrictions. Mounting holes 20 are provided at each corner of the body 17 of the insert 10 which allows for a leak free connection to the carburetor or throttle body 11 outlet and the intake manifold 12

A nitrous oxide manifold 15 is positioned upstream of a fuel manifold 16 and such that the nitrous oxide manifold 15 is directly above and axially aligned with the fuel manifold 16 with a small space therebetween. Both the oxidizer manifold 15 and the fuel manifold 16 are provided with a plurality of orifices generally denoted 20 and 21, respectively, in a row on either side of the manifolds. The rows are separated from each other by an included angle of approximately 120 degrees when viewed in a plane perpendicular to the axial centerline (or the longitudinal axis) of the manifolds 15 and 16. Thus, the general direction of the spray from each of the manifolds 15 and 16 is outward from the manifolds and downward in the direction of the flow of the fuel-oxidizer mixture.

Figure 11:
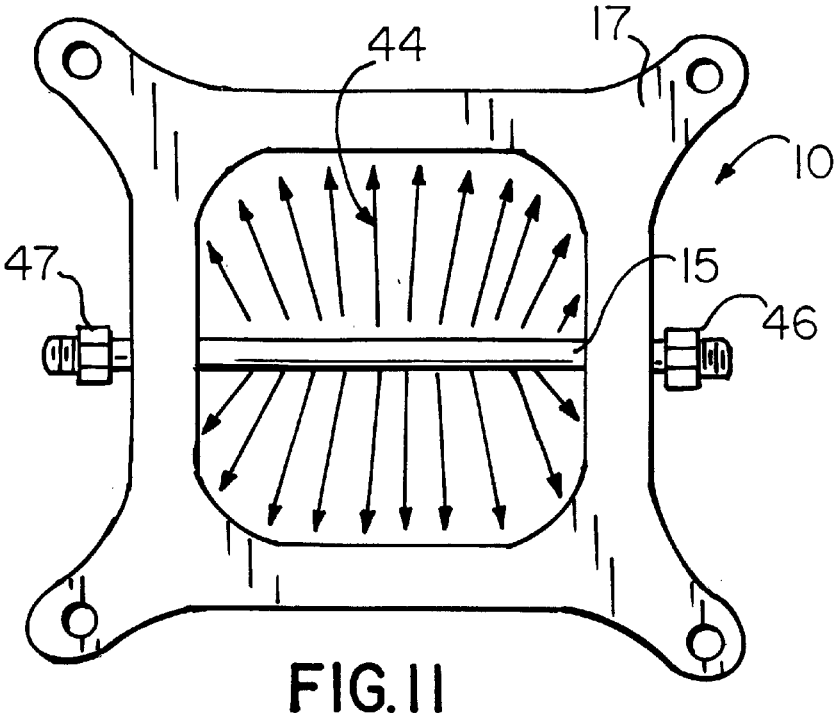
FIG. 11 is a top plan view of the spray pattern of the manifolds of FIGS. 9 and 10.
Figure 12:
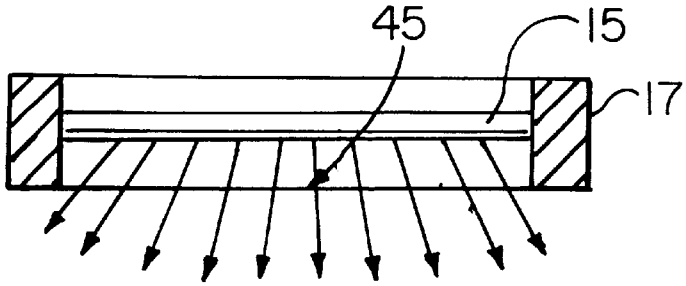
FIG. 12 is a side plan view of the spray pattern of the manifolds of FIGS. 9 and 10.

The preferred direction and pattern of the spray of the orifices 20 and 21 from manifolds 15 and 16 are shown in FIGS. 11 and 12. FIG. 11 illustrates a radial outward pattern 44 and FIG. 12 illustrates a downward pattern 45. In addition to the arrangement of the orifices generally denoted as 20 and 21 described above, the individually denoted orifices 22 through 43 are preferably arranged as follows. The orifices in the nitrous oxide manifold 15 are evenly numbered while the orifices in the fuel manifold 16 are oddly numbered. The center orifices 22 and 23 are drilled perpendicular to the longitudinal axis of the manifolds. As the orifices extend from the axial center of the manifolds to their ends where the manifolds meet with the sides of the internal opening 18 in the insert 10, the angle of each succeeding orifice increases by approximately six degrees from the perpendicular orifices 22 and 23 at the center of the manifolds to a maximum at the end orifices 42 and 43. Thus, the end orifices 42 and 43 are drilled at an approximate angle of 60 degrees from the perpendicular line of the center orifices 22 and 23 with the angle of each intermediate orifices 24–41 being approximately 6, 12, 18, 24, 30, 36, 42, 48 and 54 degrees. The diameter of the orifices in the nitrous oxide manifold 15 is approximately 0.020", while the diameter of the orifices in the fuel manifold is approximately 0.020". It is to be noted that the invention is not to be limited to the preferred embodiment described above. Different numbers of orifices, different sizes of the orifices, and different angles of the orifices, relative to the longitudinal axis of the opening in the housing 17 of the insert 10, are all intended to be within the scope of the invention.

FIGS. 6 and 7 illustrate construction of the preferred embodiment of the present invention consistent with the above description. Each end of the manifolds 15 and 16 is fixedly connected to the body 17 of the insert 10 in extending from one side thereof to the opposite side. Tube fittings 46 and 47 are respectively attached to one end of each of the manifolds 15 and 16. The tube fittings are respectively connected to a source of nitrous oxide and a source of fuel. Positioning the tube fittings on opposite sides of the insert 10 allows for unrestricted access and connection to the sources of nitrous oxide and fuel.

FIGS. 2, 4, 5, and 8 illustrate further details of the present invention. Here, the insert apparatus 10 is provided with one or more burst diaphragms 50, which serve to prevent damage to the intake manifold 12 and the carburetor or throttle body 11, in the event of a backfire. The burst diaphragm 50 comprises a thin metal disk member 51, which is scored such that it bursts open at a pre-prescribed pressure differential across the disk 51.

In the embodiment shown, the burst diaphragm disk 51 is circular in shape and is fitted against a shoulder 52 of a counter bored opening 53 through the wall of the insert 10. A nut 54, having a hole 55 therethrough, is threaded into opening 53 in the wall of the insert 10 and tightly secured against the outer rim of the burst diaphragm disk 51, which in turn tightly secures the opposite side of the rim of the disk 51 against the shoulder 52.

The hole 55 through nut 54 may include a hexagonal configuration to allow tightening of the nut 54. Alternatively, blind holes may be provided in the outside surface of the nut 54, so as to allow tightening by a spanner wrench.

In order to rapidly reduce the pressure of a backfire, a plurality of burst diaphragms 50 may be used. Taken together, a plurality of burst diaphragms 50 provide for a larger cross-sectional flow area to quickly relieve the pressure caused by the backfire.This arrangement also provides redundancy to assure that the backfire pressure is relieved when the designed pressure differential occurs.

The location of the burst diaphragms 50 on the body 17 of the insert 10 also provides a desirable safety feature. In the event of a backfire and rupture of the burst diaphragms 50, the advancing flame is directed in a plane above the engine and therefore away from the engine compartments which can catch on fire. An engine fire is to be avoided at all costs and is achieved by the present invention.

The location of the burst diaphragm 50 on the body of the insert 10 further provides for ease of replacement and minimizes the down time needed to replace ruptured diaphragms 50. It is a simple matter for a mechanic to replace ruptured diaphragms 50, which are readily accessible, and in plain view as provided in the present invention.

Obviously, other shapes of the burst diaphragms 50 may be used with the present invention. For example, one long rectangular shaped diaphragm may be used on opposite sides of the insert 10. However, round diaphragms are preferred.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved.

I claim as my invention:

1. Insert apparatus adapted to be used with an intake system of an internal combustion engine comprising:

a housing having an opening therethrough;

a first manifold;

a second manifold, and one or more burst diaphragms.

2. The apparatus of claim 1, wherein said first and second manifolds extend across said opening in said housing.

3. The apparatus of claim 2, wherein said first and second manifolds are arranged one above the other and extend in the same direction across said housing.

4. The apparatus of claim 3, wherein each of said manifolds has an inlet in a wall of said housing.

5. The apparatus of claim 4, wherein said manifold inlets are arranged on opposite walls of said housing.

6. The apparatus of claim 2, wherein said manifolds each comprise a tube having a plurality of orifices in a wall of said tubes, said orifices extending in a spaced relationship along the length of said tubes.

7. The apparatus of claim 6, wherein said orifices are arranged in two or more parallel rows in said wall of each tube, each row extending in a line across the length of said tube, said rows having an included angle between intersecting centerlines of the orifices in each row.

8. The apparatus of claim 7, wherein one or more of said orifices has a centerline arranged substantially perpendicular to a centerline of said tube.

9. The apparatus of claim 7, wherein a centerline of a first orifice in at least one of said rows is arranged perpendicular to a longitudinal axis of said tube, and each successive orifice on each side of said first orifice is arranged at an increasing angle away from the perpendicular centerline of said first orifice.

10. The apparatus of claim 7, wherein said included angle between each row of orifices is within the range of zero degrees to one hundred and eighty degrees.

11. The apparatus of claim 1, wherein one of said manifolds comprises a fuel manifold and the other of said manifolds comprises a nitrous oxide manifold.

12. The apparatus of claim 1, wherein said one or more burst diaphragms are arranged in a sidewall of said housing.

13. The apparatus of claim 1, wherein said one or more burst diaphragms is removable and secured to said wall of said housing by a fastener which is accessible from outside of said wall of said housing.

14. The apparatus of claim 13, wherein said one or more burst diaphragms comprises a thin-walled member designed to burst at a discrete pressure differential between an inside and an outside of said housing.

15. The apparatus of claim 1, wherein said insert apparatus is connected between a carburetor and a fuel inlet manifold of said internal combustion engine.

16. The apparatus of claim 1, wherein said insert apparatus is connected between a throttle body and a fuel inlet manifold of said internal combustion engine.

* * * * *